United States Patent [19]

Libby et al.

[11] 4,426,153

[45] Jan. 17, 1984

[54] APPARATUS FOR THE REDUCTION OF IMAGE INTENSITY VARIATIONS IN A CONTINUOUSLY VARIABLE REDUCING COPIER

[75] Inventors: Edwin L. Libby, Longmont, Colo.; Randall A. Maddox, Lexington, Ky.; Douglas J. Roberts, Longmont, Colo.

[73] Assignee: IBM Corporation, Armonk, N.Y.

[21] Appl. No.: 419,104

[22] Filed: Sep. 16, 1982

Related U.S. Application Data

[63] Continuation of Ser. No. 50,849, Jun. 21, 1979, abandoned.

[51] Int. Cl.[3] ..... G03G 15/00

[52] U.S. Cl. ..... 355/3 R; 355/8; 355/11; 355/14 E; 355/55; 355/57

[58] Field of Search ..... 355/8, 3 R, 55–60, 355/11, 14 E, 4, 67

[56] References Cited

U.S. PATENT DOCUMENTS

| | | | |
|---|---|---|---|
| 3,105,425 | 10/1963 | Cerasani et al. | 355/11 X |
| 3,266,366 | 8/1966 | Hunt | 355/11 X |
| 3,926,518 | 12/1975 | Berry et al. | 355/8 |
| 3,981,577 | 9/1976 | Tsilibes | 355/4 |
| 4,057,342 | 11/1977 | Allis | 355/8 |
| 4,080,067 | 3/1978 | Massengell | 355/67 |
| 4,118,118 | 10/1978 | Barto, Jr. | 355/8 |
| 4,126,388 | 11/1978 | Kawai | 355/3 R X |
| 4,126,389 | 11/1978 | Ikeda et al. | 355/55 |
| 4,209,248 | 6/1980 | Gibson et al. | 355/8 |

FOREIGN PATENT DOCUMENTS

| | | | |
|---|---|---|---|
| 1079231 | 8/1967 | United Kingdom | 355/8 |
| 1296955 | 11/1972 | United Kingdom . | |

*Primary Examiner*—A. C. Prescott

*Attorney, Agent, or Firm*—Pollock, Vande Sande & Priddy

[57] ABSTRACT

Image transferring apparatus for a continuously variable reduction electrostatic copier. A single fixed aperture is employed, adjacent the object plane, to:

(1) reduce image intensity variations caused by non-uniform illumination across the object plane;

(2) correct for lens $\cos^4$ losses for one mode of reduction;

(3) reduce image distortions due to photoconductor drum curvature, particularly at edges; and (4) reduce image illuminance variations due to changes in reduction mode throughout a continuous range of reduction modes.

In accordance with preferred embodiments, the foregoing functions are achieved notwithstanding movement in image or optical center line as a function of reduction to compensate for corner referencing objects to be copied. The single fixed aperture provides for adequate reduction in intensity variations, i.e., in an embodiment of the invention, image intensity varies plus or minus 6% from nominal levels across the image plane as reduction mode is varied throughout the range of reduction modes.

9 Claims, 5 Drawing Figures

APPARATUS FOR THE REDUCTION OF IMAGE INTENSITY VARIATIONS IN A CONTINUOUSLY VARIABLE REDUCING COPIER

This is a continuation, of application Ser. No. 50,849, filed June 21, 1979, now abandoned.

DESCRIPTION

1. Technical Field

The present invention is directed to an image transferring apparatus particularly suited for continuously variable reducing electrostatic copiers.

2. Background Art

Contemporaneous with the commercialization of electrostatic copiers, there has been a desire to increase the capability of the copier without, at the same time, degrading its performance. One particularly desirable feature which has been introduced with commercial electrostatic copiers is the capability of reducing the object image so that the copied image is reduced in size from the object image. The advent of copiers capable of this reducing function required the solution of several problems, i.e., those particularly caused by changes induced as a result of the changes in the optical configuration required to reduce the image. While the solution of these problems in a laboratory environment may be trivial, the constraints imposed by the commercialization of these devices made the solution to these problems more difficult. In particular, the commercial device capable of reduction had to exhibit the same image sharpness and consistency of image intensity with desirably little or no increase in equipment size, cost or maintenance difficulty.

While a copier capable of reducing an image satisfies more of the users' need than a machine which is not so capable, it was also desirable to increase the number of reduction modes and finally to provide for continuously variable reduction within some specified range of reduction modes. In connection with this description, a reduction mode is defined as a machine configuration to produce a specified reduction ratio, not equal to 1. As the number or reduction modes is increased until it becomes essentially continuous, the number of optical problems to be solved increases, and with the constraints imposed on commercial devices, the difficulty in solving these problems increases.

Desirably, the copied image produced by a copier is uniform in intensity, and the achievement of this requires careful design. Even if one assumed uniform object illumination (which is usually not actually the case due to size limitations), the presence of a lens in the optical path results in image intensity reduction for that portion of the image passed off the lens or optical center line, i.e., so-called $\cos^4$ losses. In the prior art, solutions to this difficulty have been achieved by shaping the object illumination so as to compensate for the image intensity falloff, and similar shaping has been used to compensate for otherwise uneven object illumination.

However, the introduction of a reduction capability caused further variations in the image intensity since, as reduction is introduced, image intensity at the image plane increases. The variations in intensity in a machine which included a single reduction mode (i.e., a reduction ratio other than 1) had been compensated for in the prior art by adding an aperture only in the reduction mode to limit image intensity in that mode. This aperture, mask or light stop, could theoretically be located either adjacent the image plane or adjacent the object plane, and in the case of its location near the object plane, it could be located between the source of illumination and the object or between the object and the lens.

A further complication arises in some machines which are capable of reducing by reason of the relationship between the center line of objects of different sizes. in one group of machines, the center line is not changed, i.e., the objects are center-referenced; obviously, this causes no additional difficulties. However, in another group of machines, the objects to be copied are corner referenced, and as a result, as the object to be copied increases in size, and the reduction mode is correspondingly changed, the center line moves or changes in position relative to center line of a smaller object to be copied. This "corner-referencing" serves to increase the difficulties associated with $\cos^4$ losses and drum curvature distortions, since more of the image to be reproduced falls in the edge areas whose intensity would be reduced absent some special attention.

In machines capable of a given small number of reduction modes, image intensity variations, in the prior art, were handled by arranging the illumination in a base mode to be relatively uniform, and then substituting a different mask, light stop or aperture, for each different mode to maintain the uniformity of intensity. However, as can be realized, when the number of reduction modes is increased to such a point that the reduction capability is essentially continuous the requirement to provide different masks, light stops or apertures, for each reduction mode, renders the system unmanageable in terms of equipment size, cost or maintainability. Accordingly, there has been a desire for achieving the capability of essentially continuously variable reduction, while maintaining image intensity relatively constant in a simple and relatively inexpensive manner.

A system capable of achieving some of these goals is shown in Allis U.S. Pat. No. 4,057,342, issued on Nov. 8, 1977. This patent discloses a copying system with a pair of apertures (light stops, masks, slits, etc.) located in the optical path and capable of operating in a base mode and a reduction mode. The patentee recognized that additional reduction modes could be employed and, while image intensity variations would occur, the exposure system would provide a degree of correction. The patentee also indicates, however, that a slit appropriate for a base mode or non-reduction mode of operation would probably not be adequate for reduction mode of operation and correspondingly, a slit provided for uniform illumination in a reduction mode of operation would not provide proper operation in a base of non-reduction mode or in a different reduction mode.

It is an object of the present invention to provide a single aperture, mask, or slit for illumination intensity control which is applicable not only to a non-reduction mode of operation, but also applicable to a reducing mode of operation. It is a further object of the present invention to provide a single fixed mask, aperture or illumination slit which is not only appropriate for both a reduction mode and a base or non-reduction mode of operation, but which is also effective in a continuous range of reduction modes between the base or non-reduction mode and the ultimate reduction mode for which the equipment is designed. It is a further object of the invention to provide practically uniform illumination of a photoconductor in a reducing copying machine, capable of reduction over a continuous range, by employing a single, fixed mask, aperture or illumination slit, which is configured to compensate for illumination changes as a result of changes in reduction ratio, illumination intensity variation as a function of position from the object center line, movement of the object center line as a result of changes in reduction ratio in a corner-referenced document, and changes in the variation of light intensity as a function of position from the object center line caused by changes in reduction mode.

DISCLOSURE OF THE INVENTION

The present invention meets these and other objects of the invention in an electrostatic reducing copying machine for reproducing an object image with the reduction in reproduced image in the range 1:1 to 1:K, where K is less than 1.0, which includes an electrostatic image carrier, means for laying down a latent image thereon, a document support, a source of illumination directed at the document support and lens means for focusing reflected illumination onto said electrostatic image carrier, means for varying the reduction ratio in the range 1:1 to 1:K, where K is less than 1, and which further includes a fixed aperture means located between the lens means and the object support for reducing image intensity variations caused by changes in the reduction ratio.

A preferred embodiment of the invention, which is for use with a source of illumination which provides an illumination profile peaking at a location displaced from a reference edge by about 50% of the maximum width document to be copied, has an aperture with a width varying from a first width at one extreme edge to a minimum width approximately in the center of the aperture to a second width which is not equal to the first width at the other extreme edge of the aperture. More particularly, the referred-to aperture has a first width at a location corresponding to the reference edge of a document and in which the second width is greater than the first width. The aperture shape can be referred to as a compound dogbone or bowtie in which width variations, proceeding from the first width to the second, first decreases to a first minimum width, and then increases slightly to a first intermediate maximum width, and then decreases to a minimum width in the approximate center of the aperture, and then increases to the second width, at the other extreme edge of the aperture. In an illustrative embodiment, arranged for use with a copying machine having K=0.647, the second width exceeds the first width by about 30%, and the minimum width is about 50–60% less than the first width.

BRIEF DESCRIPTION OF DRAWINGS

The present invention will be disclosed in further detail in the following portions of the specification when taken in conjunction with the attached drawings in which like reference characters identify identical apparatus, and in which.

BEST MODE FOR CARRYING OUT THE INVENTION

Figure 1:
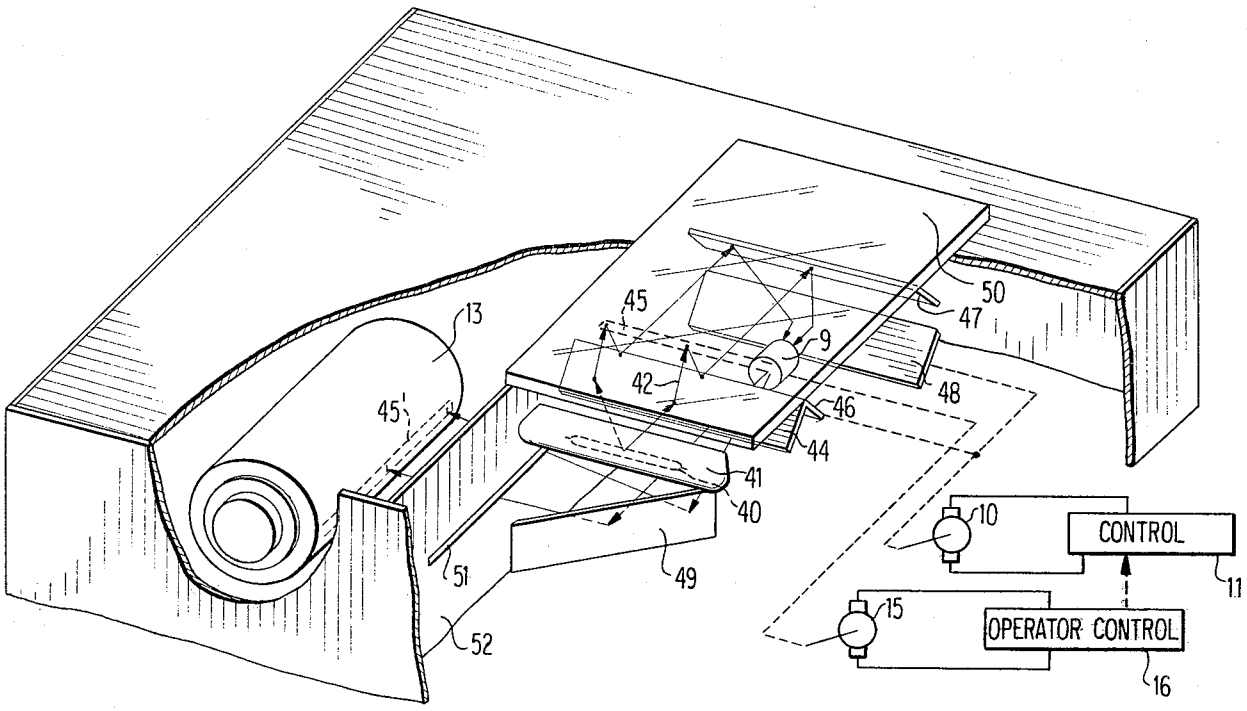
FIG. 1 is a showing of an electrostatic copier, broken away to show essential components.

A preferred embodiment of the invention is illustrated in the accompanying drawings, in connection with an essentially continuously variable reducing copying machine which can be of the type which is disclosed in application Ser. No. 721,125, filed on Sept. 7, 1976, abandoned in favor of application No. 904,706, now U.S. Pat. No. 4,209,248. The application discloses an essentially continuously variable reducing electrophotographic copier with about 90 discrete reduction ratios in the specified range, and will be hereinafter referred to as continuously variable. The disclosure of the application is incorporated herein by reference. FIG. 1 is a showing of the essential components of the copying machine, in schematic fashion.

Thus, a transparent platen or document support 50 is arranged to support a document to be copied. Illumination for the copying process is provided by the lamp 40, and reflectors 41, 44 are provided to reflect the illumination to impinge on the support 50. The source 40, the elliptical reflector 41 and the dichroic reflector 44 are arranged so that the illumination on the platen describes a focused line of light 45. Illumination, reflected by the object to be copied, is directed to a mirror 46, and from thence to mirrors 47–48. Illumination reflected from the mirror 48 passes through a lens 9, is reflected by a further mirror 49, passes through a slit 51 in a wall 52 of the machine and impinges on the surface of a drum 13. Thus, the image of the line of light 45 is reproduced on the surface of the drum 13 as a line of light 45'. In order to reproduce the image of an entire document, a first carriage supporting the light source 40, reflector 41 and mirrors 44, 46 and a second carriage supporting the mirors 47–48 are translated parallel to the longer dimension of the platen 50. As the carriages are translated, the line of light 45 scans the document to be copied and produces a corresponding image thereon on the surface of the drum 13, as that drum rotates.

As is well known to those skilled in the art, a latent image of the object to be copied is produced on the drum 13, and this latent image is later transferred to the copy paper so that the image which the object bears is reproduced on the copy paper.

As is disclosed in the aforementioned application, reduction is achieved by selectively positioning the lens 9 and appropriately controlling the scanning of the first and second carriages in conjunction with the motion of the drum 13. The apparatus to position the lens 9 is schematically shown in FIG. 1 as comprising a motor 15 operated under operator control 16. Motion of the first and second carriages is controlled by a motor 10 under the control of control apparatus 11.

For each discrete position of the lens 9 within its intended operating range, the electrophotographic copying machine shown in FIG. 1 achieves a unique reduction ratio, and thus, the machine is capable of a range of reduction ratios or reduction modes within the range of movement of the lens 9. In a preferred embodiment of the invention, the machine is capable of reducing modes in the range 1:1 to 1:K where K is 0.647.

Figure 2:
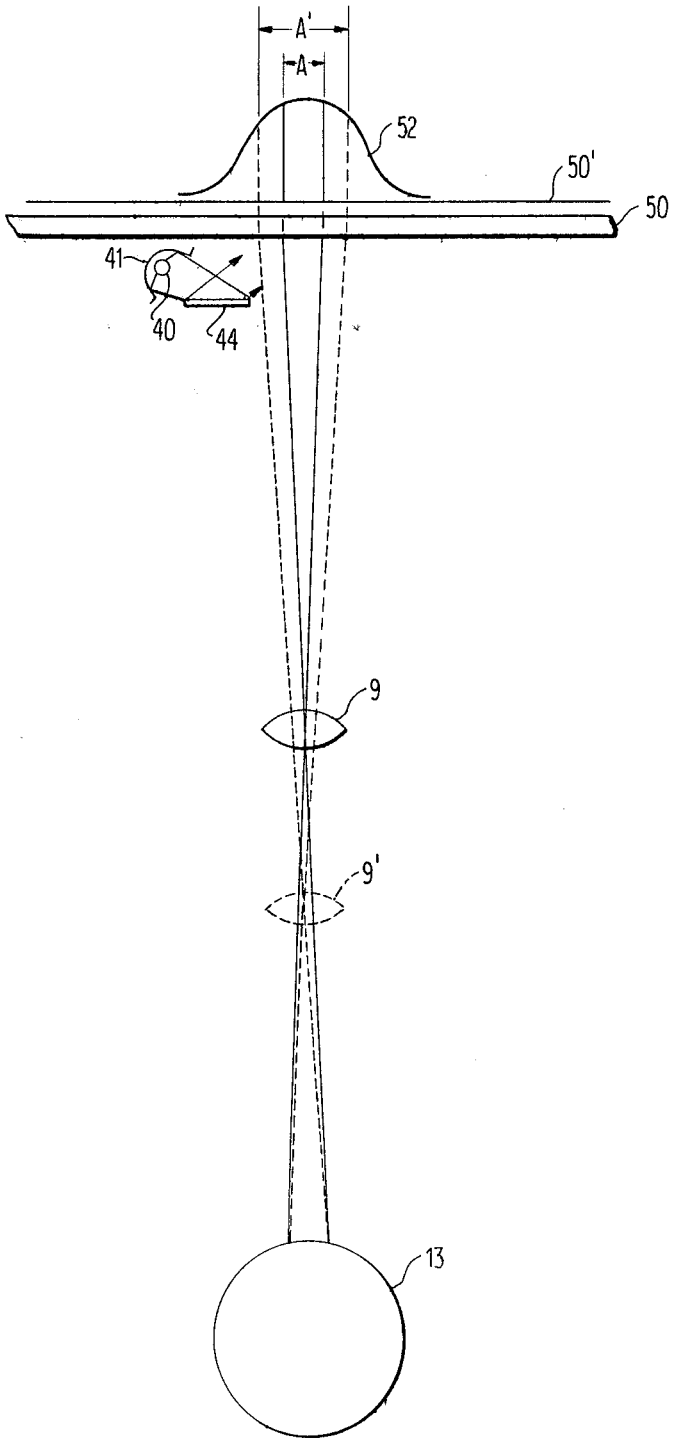
FIGS. 2 and 3 illustrate the optical path and the relation of several parameters related thereto.

A schematic showing of the optical path of FIG. 2 is useful in illustrating the problems which require solution. In FIG. 2, the optical path has been straightened; those skilled in the art will understand that the following discussion will apply not only to optical paths of the type shown in FIG. 2, but will also apply to folded optical paths such as that shown in FIG. 1.

FIG. 2 schematically illustrates the illumination source including lamp 40, reflectors 41 and 44, in relation to the platen 50 and an image-bearing object 50' whose image is desired to be copied. The illumination from the illumination source is reflected by the document in accordance with the image on the document 50', and is coupled through the lens 9 to be focused on the surface of the drum 13. If we assume that the distance along the optical center line of the lens 9 from the object to the lens is equal to the distance from the lens to the surface of the drum 13, then the image at the drum 13 will be of the same size as is the image on the object 50', i.e., no reduction will be produced. With most practical illumination sources, the distribution of object light intensity is non-uniform. A typical profile is reproduced by the curve 52 in FIG. 2. An incremental area of curve 52 labelled A will be "seen" by an incremental area on the drum 13. As the relative position of the illumination source and object 50' are changed during the scan, so the image produced at the surface of the drum 13 changes, and as the drum 13 rotates, this change produces on drum 13 a latent image of the entire document.

As explained in connection with FIG. 1, reduction is achieved by repositioning the lens 9, so that for an arbitrary reduction mode, the lens 9 will be located at the position 9'. This has the effect of increasing the effective illuminated area viewed by the drum from the portion A to the portion A' which increases the the image intensity at the drum 13, as compared with the intensity that would have been produced at the drum 13 had the lens been in the position 9. As a result, image intensity will be related to reduction mode, directly contrary to the desired goal of relatively constant image intensity regardless of reduction mode.

Figure 3:
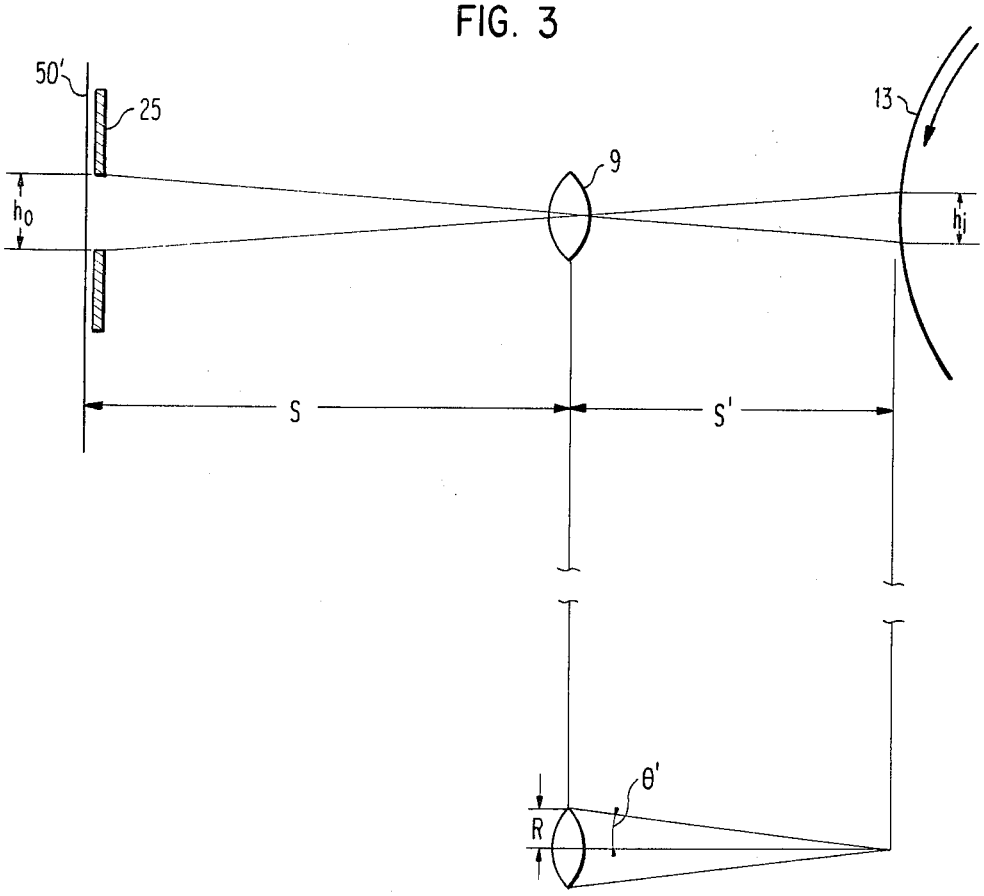
Figure 5:
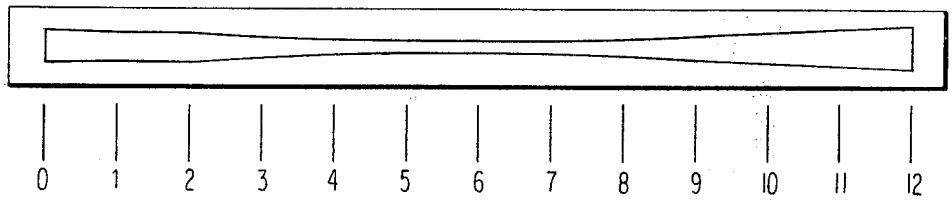
FIG. 5 is a plan view of a typical light stop, aperture or the like to limit image intensity variations.

In order to evaluate the extent of this image intensity variation, we can refer to FIG. 3, which is similar to FIG. 2 except that the illumination package has been eliminated as not being essential to this discussion. From the preceding discussion, it will be understood that the distances S and S' are varied in order to change the reduction mode. The irradiance produced at the plane of an image is given by $H=T\pi N \sin^2 \theta'$ (watt cm. $^{-2}$), where T is the system transmittance, N is the object radiance (in units of watt STER$^{-1}$cm.$^{-2}$), and $\theta'$ is the half angle subtended by the exit pupil of the optical system from the image. For small angles, we can substitute for the sin $\theta'$, R/S'. In addition, $1/S'=-1/S+1/f$, and $s'=mS$ where m is the magnification or reduction mode. We can also write $S'=f(m+1)$ and therefore, the irradiance H equals $(T\pi NR^2/f^2(m+1)^2)$ in units of watts per square centimeter.

The preceding expression illustrates how the irradiance varies in accordance with reduction mode m.

In accordance with the invention, an aperture, the aperture 25 of fixed dimensions, is located to limit the reflection from the object 50' to a fixed width $h_0$.

Other problems corrected by this aperture are those caused when a flat object plane is imaged onto a curved surface, i.e., the photoconductor drum. One effect is velocity smear, where the image-plane component of the drum tangential velocity vector is less in magnitude than the image velocity vector. Another is an "edge effect" called elliptical side smear wherein a point on the object plane is not imaged continuously during exposure on the same point on the drum. Both these effects are overcome by providing a sufficiently narrow image height, $h_i$, controlled, in turn, by the height, $h_o$, of the object aperture.

In a copier, exposure energy density (joules per cm$^2$) is the quantity of interest, and that is merely the irradiance multiplied by the exposure time. The exposure time is the height $h_i$ of the illuminated image area divided by the drum tangential velocity v. However, for paraxial optics, we can write $h_i=mh_o$. Thus, we can write that E (the exposure energy density) equals $$(T\pi NR^2h_o/f^2v)\ ((m)/(m+1)^2$$

wherein the leftmost quantity is a constant, since we have limited the effective reflecting area of the object by aperture 25.

Accordingly, the energy exposure density can be written as $K\cdot m/(m+1)^2$. For two different reduction modes, the exposure energy density ratio $E_1/E_2$ is equal to $m_1(m_2+1)^2/m_2(m_1+1)^2$. For the parameter of M equal to 0.647, this expression indicates a change in energy exposure density of about 5%, which is an acceptable variation. However, the preceding discussion is applicable only along the center line, and does not treat edge effects or reduction in intensity off the optical center line.

In general we can write that the image illumination $E_i$ is equal to TBW $\cos^4 \phi$, where T is a function of the lens (and any mirror) transmittance and B is the object brightness, and $\phi$ is the angle between the image position and the lens center line, and W (omega) is the solid angle subtended by the lens aperture to a given point in the image.

The average object brightness is a function of the light energy distribution illuminating the object and the attenuation of this light due, for example, to the aperture 25 referred to above. That is, $B=KB_o$, where $B_o$ is the object brightness. Therefore, $E_i=TWKB_o \cos^4 \phi$. However, we can write $K=K_A\times K_{ill}$, where K is the brightness coefficient which is variable, $K_A$ is the aperture width ratio and $K_{ill}$ is the object illumination intensity ratio. Thus, we can write that $E_i= TWK_AK_{ill}B_o \cos^4 \phi$.

In order to insure that $E_i$ is a constant across the image plane, we set $K_A=1/K_{ill} \cos^4 \phi$.

Accordingly, by employing the fixed aperture of aperture width ratio $K_A$ we can reduce image intensity variations as a function of reduction mode, $\cos^4 \phi$, and object illumination variations.

Figure 4:
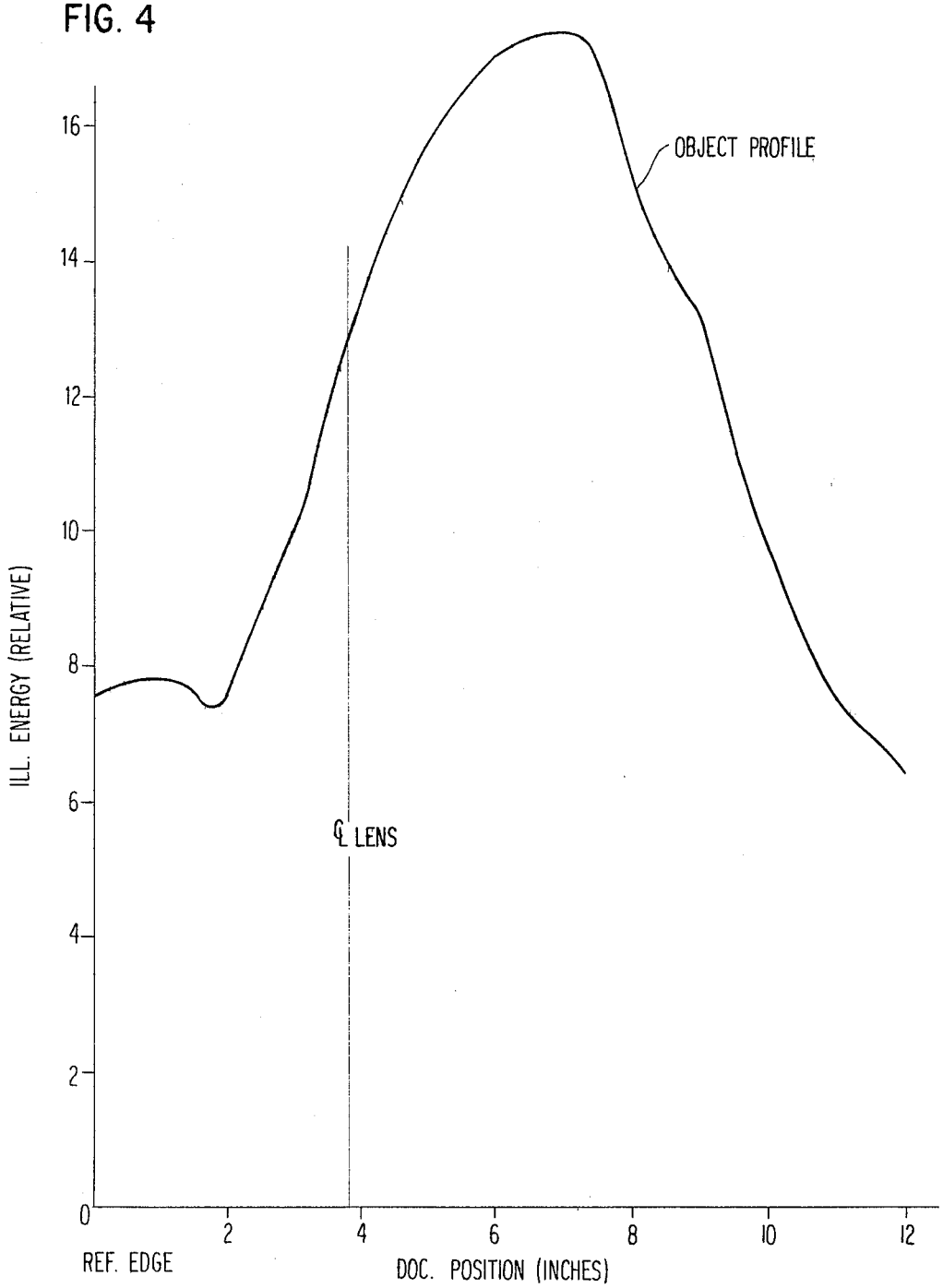
FIG. 4 is a typical illumination profile at the object plane.

A practical copying machine will not have an object illumination footprint which is constant across the object, and therefore, the aperture width ratio must also reflect shaping to reduce intensity variations as a result of object illumination variation caused by the particular illumination package employed. For example, FIG. 4 is the object illumination profile for a practical illumination package. It can be seen that, for example, the illumination changes by a factor of more than two to one from the reference edge across the object width.

Table I reproduced below illustrates object illumination as a function of image position or distance from the reference edge, with the first two columns of Table I merely reproducing the information shown in FIG. 4. The third column illustrates relative illumination, $K_{ill}$, normalized to the reference edge. The next column corrects for $\cos^4$ losses by multiplying the factor $K_{ill}$ by $\cos^4$ of the appropriate angle, depending upon image position. The factor $K_A$ is the reciprocal of that product.

Finally, the last column shows the aperture width which is obtained by starting with the nominal aperture width, for example, 0.4 inches, and dividing that quantity by the associated factor $K_A$ to determine the ratio that is used to multiply all $K_A$ factors to obtain associated apertures.

TABLE I

| Image Position (Inch. fr. Ref. Edge) | Illumination (Object) | $K_{ill}$ | $K_A$ | Aperture |
|---|---|---|---|---|
| 0 | 7.76 | 1.00 | 1.109 | .400 |
| 1 | 7.83 | 1.01 | 1.048 | .377 |
| 2 | 7.56 | .974 | 1.05 | .378 |
| 3 | 10.15 | 1.308 | .768 | .277 |
| 4 | 13.3 | 1.714 | .583 | .210 |
| 5 | 15.87 | 2.045 | .494 | .178 |
| 6 | 17.098 | 2.203 | .470 | .169 |
| 7 | 17.45 | 2.247 | .479 | .172 |
| 8 | 15.192 | 1.95 | .581 | .172 |
| 9 | 13.3 | 1.714 | .686 | .276 |
| 10 | 9.89 | 1.274 | .936 | .374 |
| 11 | 7.64 | .987 | 1.233 | .443 |
| 12 | 6.68 | .860 | 1.470 | .588 |

Based on these factors, the aperture width from reference edge across an 8" document width can be determined. Similar calculations can also be used for widths beyond 8", however, it was found in practice that the calculated values had to be adjusted empirically to fit within acceptable light intensity variations. For any position from the reference edge the light intensity for a candidate aperture width (at 1:1) can be found by multiplying $K_{ill}$, $K_A$ and $\cos^4 \phi$. At any arbitrary reduction mode similar calculation can be made but correction must be made for changes in lens position which, in turn, affects the $\cos^4 \phi$ values. Using these procedures, image intensity can be determined for allowable reduction modes and the aperture width can be selected so as to provide limited image intensity variations.

In the preferred embodiment of the invention referred to, the resulting aperture reduced image intensity variations to within ±6%, notwithstanding image intensity variations as a result of reduction mode variations and other factors throughout the entire range of reduction modes.

Having thus described our invention, what we claim as new and desire to secure by Letters Patent is:

1. An electrostatic reducing copying machine for reproducing an object with a reduction in a reproduced image in the range 1:1 to 1:K, where K is less than about 0.8 and image intensity variation is ±6% or less throughout said range, comprising:

an electrostatic image carrier;

means for laying down a latent image thereon including a document support, a source of illumination directed at said document support and lens means for focusing reflected illumination onto said electrostatic image carrier;

means for continuously varying the reduction ratio in the range 1:1 to 1:K, where K is less than about 0.8 or less, wherein the improvement comprises:

a single fixed aperture means located between said lens means and said object support for reducing image intensity variations, caused by changes in said reduction ratio, and by non-uniform illumination across said object plane, and correction for lens $\cos^4$ losses, to within ±6%.

2. The apparatus of claim 1 wherein said single fixed aperture has a compound dogbone shape including a first portion extending from an edge of said aperture which narrows in width to a minimum width and then increases in width.

3. The apparatus of claim 1 in which said source of illumination provides an illumination profile peaking at a point about 50% of the maximum width document to be copied from a reference edge.

4. The apparatus of claim 2 in which said single fixed aperture has a width varying from a first width at an extreme edge, to a minimum width approximately in the center of said aperture, to a second width which is not equal to said first width at another extreme edge of said aperture.

5. The apparatus of claim 4 in which said first width corresponds to a reference edge of a document to be copied and said second width is greater than said first width.

6. The apparatus of claim 5 in which said width decreases to a first minimum width and then increases slightly to a first intermediate maximum width before decreasing to said minimum width.

7. The apparatus of claim 4 in which K is about 0.65 and in which said second width exceeds said first width by about 30%.

8. The apparatus of claim 4 in which said minimum width is about 50–60% less than said first width.

9. The apparatus of claim 1 wherein said means for varying the reduction ratio includes means for moving said lens means so as to vary a distance between said document support and said electrostatic image carrier and also to vary lens center line with respect to said document support, allowing documents on said document support to be corner referenced.

* * * * *

UNITED STATES PATENT AND TRADEMARK OFFICE

CERTIFICATE OF CORRECTION

PATENT NO. : 4,426,153

DATED : January 17, 1984

INVENTOR(S) : Libby et al

It is certified that error appears in the above-identified patent and that said Letters Patent is hereby corrected as shown below:

Col. 2, line 8, change "in" to -In-.

Col. 5, line 31, change "the the" to -the-.

Col. 6, line 12, change "$(T\pi NR^2h_o/f^2v)((m)/(m+1)^2$" to $-(T\pi NR^2h_o/f^2v)((m)/(m+1)^2)-$.

Signed and Sealed this

*Seventeenth* Day of *April 1984*

[SEAL]

*Attest:*

GERALD J. MOSSINGHOFF

*Attesting Officer*

*Commissioner of Patents and Trademarks*